US005611725A

United States Patent [19]

Imahashi

[11] Patent Number: 5,611,725

[45] Date of Patent: Mar. 18, 1997

[54] MAGNETIC BARRELL FINISHING MACHINE

[75] Inventor: Takahiro Imahashi, Kokubunji, Japan

[73] Assignee: Imahashi Mfg. Co., Ltd., Tokyo, Japan

[21] Appl. No.: 437,587

[22] Filed: May 9, 1995

[30] Foreign Application Priority Data

Aug. 12, 1994 [JP] Japan ..... 6-190717

[51] Int. Cl.[6] ..... B24B 1/00

[52] U.S. Cl. ..... 451/104; 451/326; 451/36

[58] Field of Search ..... 451/326, 327, 451/36, 35, 104, 113, 32

[56] References Cited

U.S. PATENT DOCUMENTS

| | | | |
|---|---|---|---|
| 4,175,930 | 11/1979 | Sakulevich et al. | 451/36 |
| 4,211,041 | 7/1980 | Sakulevich et al. | 451/287 |
| 4,599,826 | 7/1986 | Podoprigora | 451/177 |
| 5,044,128 | 9/1991 | Nakano | 451/32 |
| 5,419,735 | 5/1995 | Imahashi | 451/35 |

FOREIGN PATENT DOCUMENTS

| | | | |
|---|---|---|---|
| 5285822 | 11/1993 | Japan | 451/113 |
| 6091518 | 4/1994 | Japan | 451/113 |
| 1361881 | 2/1988 | U.S.S.R. . | |

*Primary Examiner*—Timothy V. Eley
*Assistant Examiner*—Dona C. Edwards
*Attorney, Agent, or Firm*—Wenderoth, Lind & Ponack

[57] ABSTRACT

A magnetic barrel finishing machine causes multiple different flows or motions of the abrasive media and workpieces by varying magnetic fields, thereby freeing the workpieces from the abrasive media and subjecting the workpieces to finishing action by the abrasive media. The machine includes a rotator made of magnetic material and a plurality of permanent magnets rigidly mounted on the rotator. A container is located above the rotator with a small gap therebetween, and contains workpieces to be finished and an abrasive medium of magnetic material, or workpieces to be finished and an abrasive medium including a magnetic material. The permanent magnets are arranged irregularly in such a way that they provide magnetic lines of force acting in the circumferential direction as well as the radial direction of the rotator.

15 Claims, 14 Drawing Sheets

MAGNETIC BARRELL FINISHING MACHINE

BACKGROUND OF THE INVENTION

1. Field of the Invention

The present invention relates to a magnetic barrel finishing machine capable of generating multiple different flows of abrasive by changing a magnetic field thereof so as to uniformly finish the workpieces.

2. Description of the Prior Art

There has been known a metal finishing machine characterized by regularly arranged permanent magnets on a non-magnetic disk. The known machine changes the magnetic field by rotation of the disk, allowing abrasives and free workpieces in a container to flow in the circumferential direction, thereby finishing the free workpieces (Examined Japanese Patent Publication No. HEI 4-26981, and Unexamined Japanese Patent Publication No. SHO 60-118466).

When a container filled with workpieces to be finished is placed at a central portion of the non-magnetic rotary disk, the workpieces tend to be finished unevenly, and therefore extra time is required until the finishing process is completed. Moreover, since the poles of the magnets are arranged in the order of N,S:N,S, an alternating magnetic field is generated in the circumferential direction. This regular arrangement of the poles may produce flows of abrasives repeatedly but regularly, and in some cases this causes irregular finishing of the workpieces or requires a lot of time for completion of the finishing process. Additionally, in the case of using a non-magnetic disk, there is a disadvantage in generating magnetic loss.

For example, as shown in FIG. 7 or 8, the conventional regular arrangement of poles such as N, S, N, S generates flows of abrasives along the same circumference (as shown by arrow 21 and loop 22).

Accordingly, a container 23 which contains workpieces and media (such as magnetic materials, abrasives, or compounds) must be disposed within a magnetic zone 24 (see FIG. 9). It is apparent that since the magnetic zone 24 is formed in a doughnut shape, the diameter of the container 23 must be set at a value ½ or less the diameter of a rotary disk 25.

In the case where the diameter of the container 23 is substantially equal to that of the rotary disk 25, a loop 22 is not generated at a central portion 26 as shown in FIG. 8, so that the workpieces at the central portion 26 are insufficiently finished, which leads to uneven finishing of the workpieces as a whole. To cope with this problem, a cylindrical body is sometimes put at the central portion of the container 23.

SUMMARY OF THE INVENTION

The above-described problem caused in the case where a magnetic field is regularly changed can be solved and also a magnetic force can be reinforced, according to the present invention, by regularly or irregularly arranging permanent magnets on a magnetic rotator.

According to the present invention, a magnetic barrel finishing machine has a plurality of permanent magnets rigidly mounted on a rotator made of a magnetic material and a container for containing workpieces to be finished and an abrasive medium of magnetic material, or workpieces to be finished and an abrasive medium including a magnetic material. The container is located above the rotator such that a gap is between the container and the rotator, wherein the plurality of permanent magnets are irregularly arranged on the rotator such that the plurality of permanent magnets provide magnetic lines of force acting in a circumstantial direction of the rotator and in inwardly and outwardly radial directions of the rotator.

Also, according to the present invention, there is provided a magnetic barrel finishing machine in which a plurality of permanent magnets are rigidly mounted on a rotator made of a magnetic material and a container for containing workpieces to be finished and an abrasive medium of magnetic material, or workpieces to be finished and an abrasive medium including a magnetic material. The container is located above the rotator such that a gap is between the container and the rotator, wherein the plurality of permanent magnets are irregularly arranged on the rotator such that the plurality of permanent magnets provide magnetic lines of force acting in a circumferential direction of the rotator and in inwardly and outwardly radial directions of the rotator. The number of poles N and S of said plurality of permanent magnets is set to be equal to each other, and the permanent magnets are rigidly mounted on the rotator symmetrically or nearly symmetrically (i.e. substantially symmetrically) relative to the center of the rotator.

According to a further aspect of the present invention, there is provided a magnetic barrel finishing machine in which a plurality of permanent magnets are rigidly mounted on a rotator made of a magnetic material, and a container for containing workpieces to be finished and an abrasive medium of magnetic material, or workpieces to be finished and an abrasive medium including a magnetic material. The container is located above the rotator such that a gap is between the container and the rotator. The plurality of permanent magnets rigidly mounted on the rotator are disposed along three concentric circles around the center of the rotator in such a manner that three poles N and three poles S are disposed at equal or nearly equal intervals along the outermost concentric circle symmetrically or nearly symmetrically relative to the center of the rotator, two poles N are disposed along the intermediate concentric circle symmetrically or nearly symmetrically relative to the center of the rotator, and two poles S are disposed along the innermost concentric circle symmetrically or nearly symmetrically relative (i.e. substantially symmetrically) to the center of the rotator. In the above, the positions of the poles N and S of the permanent magnets may be replaced with each other.

According to a further aspect of the present invention, there is provided a magnetic barrel finishing machine in which a plurality of permanent magnets are rigidly mounted on a rotator made of a magnetic material, and a container for containing workpieces to be finished and an abrasive medium of magnetic material, or workpieces to be finished and an abrasive medium including a magnetic material. The container is located above the rotator such that a gap is between the container and the rotator, wherein the plurality of permanent magnets rigidly mounted on the rotator are disposed along a plurality of concentric circles around the center of the rotator, and the centers of the permanent magnets, at least along the adjacent concentric circles, are arranged along different radius lines of the rotator.

According to a further aspect of the present invention, there is provided a magnetic barrel finishing machine in which a plurality of permanent magnets are rigidly mounted on a rotator made of a magnetic material, and a container for containing workpieces to be finished and an abrasive medium of magnetic material, or workpieces to be finished and an abrasive medium including a magnetic material. The container is located above the rotator such that a gap is between the container and the rotator, wherein the plurality of permanent magnets on the rotator have centers disposed along curves spirally extending at equal or nearly equal intervals in the outer peripheral direction from the center of the rotator. The permanent magnets disposed along one of the spiral curves is symmetric or nearly symmetric (i.e. substantially symmetric), relative to the center of the rotator, to those disposed along another one of the spiral curves which is symmetric or nearly symmetric to the one spiral curve relative to the center of the rotator.

According to a further aspect of the present invention, there is provided a magnetic barrel finishing machine in which a plurality of permanent magnets are rigidly mounted on a rotator made of a magnetic material, and a container for containing workpieces to be finished and an abrasive medium of magnetic material, or workpieces to be finished and an abrasive medium including a magnetic material. The container is located above the rotator such that a gap is between the container and the rotator. The plurality of permanent magnets on the rotator have centers disposed along curves spirally extending at equal or nearly equal intervals in the outer peripheral direction from the center of the rotator. The permanent magnets disposed along one of the spiral curves are symmetric or nearly symmetric (i.e. substantially symmetric), relative to the center of the rotator, to those disposed along another one of the spiral curves which is symmetric or nearly symmetric to the one spiral curve relative to the center of the rotator. At the portion adjacent to the permanent magnet disposed along the outer periphery of each of the spiral curves, a permanent magnet having the same pole is disposed.

According to a further aspect of the present invention, there is provided a magnetic barrel finishing machine in which a plurality of permanent magnets are rigidly mounted on a rotator made of a magnetic material, and a container for containing workpieces to be finished and an abrasive medium of magnetic material, or workpieces to be finished and an abrasive medium including a magnetic material. The container is located above the rotator such that a gap is between the container and the rotator. The plurality of permanent magnets rigidly mounted on the rotator are disposed along inner and outer double concentric circles around the center of the rotator in such a manner that two of the poles N and two of the poles S are alternately disposed at equal or nearly equal (i.e. substantially equal) intervals along the inner concentric circle and four of the poles N and four of the poles S are alternately disposed at equal or nearly equal intervals along the outer concentric circle. The permanent magnets are disposed in the inner and outer concentric circles such that the centers thereof are not positioned at the same radius line of the rotator, and only permanent magnets having either of the poles N and S are present in each of four zones partitioned by partitioning lines passing through the center of the rotator.

According to a further aspect of the present invention, there is provided a magnetic barrel finishing machine in which a plurality of connecting plates made of a magnetic material, each of which is adapted to fix permanent magnets having different poles at a specified interval, are fixed in a rotator made of a non-magnetic material. Another plurality of permanent magnets are fixed on the rotator made of a non-magnetic material. A container for containing workpieces to be finished and an abrasive medium of magnetic material, or workpieces to be finished and an abrasive medium including a magnetic material, is located above the rotator such that a gap is between the container and the rotator.

With respect to the above-described arrangement of the plurality of permanent magnets according to the present invention, the same function and effect can be obtained by the replacement of poles N and S with each other.

By the use of the rotary disk made of magnetic material on which permanent magnets are rigidly mounted, it becomes possible to reinforce the magnetic force by 20% or more as compared with the case where permanent magnets are rigidly mounted on a non-magnetic rotary disk, thus improving the finishing ability and finishing efficiency.

As the magnetic material of the rotary disk of the present invention, there may be used an iron plate or any other plate made of ferromagnetic materials.

As the rotator, a disk type is usually used; however, a square plate type or a rotary arm type may be used. For example, in the case of using the rotary arm type, permanent magnets are fixed on respective arms.

As described above, by changing the arrangement of magnets rigidly mounted on the rotator, the flows of media and workpieces caused by the rotation of the rotator can be changed somewhat. Accordingly, by replacing the rotator having permanent magnets attached thereto, the workpieces in a container can be finished by different flows of media and workpieces. In other words, the flows of media and workpieces which are suitable for the articular shapes of the workpieces (for example, small size plates, small size needles, short-size pieces, complicated pieces and the like) can be obtained by replacing the rotator having permanent magnets attached thereto.

As the abrasive media of magnetic material, or abrasive media including magnetic materials, used in this embodiment of the present invention, various magnetic materials or non-magnetic materials used for conventional barrel finishing can be used. These materials are suitable for surface finishing of workpieces made of metal, resin or glass.

As the magnetic material, there may be used stainless steel pins (diameter: 0.2–1.5 mm, length: 3.0–10.0 mm), stainless steel balls (diameter: 0.5–3.5 mm), and pins or balls made of various hard alloys other than stainless steel.

As the non-magnetic material, there may be used SiC, $Al_2O_3$, $Fe_2O_3$, $Cr_2O_3$, $Ce_2O$, any kind of diamond powder and various kinds of abrasives.

By the use of the above-described magnetic material as the abrasive media independently, a shot-peening effect can be obtained.

On the other hand, by the use of the magnetic material mixed with the above-described non-magnetic material, that is to say, by the use of abrasive media including magnetic materials, the shot-peening effect grinding and polishing can be obtained.

As the abrasive media including magnetic material, a magnetic material on which abrasives are bonded or coated may be used. For example, abrasives 83 are bonded at both the ends of a magnetic material pin 84 or coated on the whole surface of the magnetic material pin 84 as shown by FIG. 22 and FIG. 23. By the use of the magnetic material on which abrasives are bonded or coated, grinding and polishing effects can be obtained.

Also, as the abrasive media including magnetic material, a magnetic material 85, in which abrasives 86 are impregnated or mixed as shown by FIG. 24, may be used. Various abrasives which are used in the conventional barrel finishing may be included in the magnetic materials, such as ferrite, plastics, etc. By the use of magnetic material in which abrasives are impregnated or mixed, grinding and polishing effects can be obtained.

Further, as the abrasive media including magnetic material, magnetic materials with abrasive powder may be used. By the use of magnetic materials with abrasive powder, such as diamond powder, etc., the shot-peening effect, grinding or polishing can be obtained at the same time.

The above-described bonding can be made by using a metal bond, a resinoid bond, or a vitrified bond. Alternatively, abrasives may be bonded on the magnetic material by coating or electric plating.

The above-described abrasives are in the form of powder or in a form bonded on the magnetic material. Moreover, they are made by molding a mixture of abrasives and magnetic materials or non-magnetic materials such as ferrite or plastic.

The barrel finishing by the machine of the present invention can be performed under normal pressure without water, or in a state where water or another solution is added. In particular, the addition of water containing a surface active agent in a slight amount (about 0.1%) is effective to increase the finishing effect.

Depending on the kind of workpiece to be finished, barrel finishing with the machine of the present invention with a dry environment may perform well. That is to say, there are some workpieces, such as general parts of ordinary machines, which may be finished effectively by the machine of the present invention without the use of any water or other solution.

A container which contains workpieces to be finished and media is preferably made of non-magnetic material and of a closed type so as to prevent the media and workpieces from being discharged during barrel finishing. For example, a synthetic resin container provided with a lid may be used.

The allowance in positional variation (for example, extent of protrusion from the concentric circle) of each permanent magnet is specified within a range such that the permanent magnet is not affected by the adjacent permanent magnet (for example, in a range where the flow of the magnetic lines between the permanent magnets is not changed greatly). For example, the positions nearly symmetric to each other relative to the center of the rotator mean that the variation from the positions symmetric to each other relative to the center of the rotator is within a value that is half of the interval between the adjacent permanent magnets.

The rotator is not necessarily formed of a circular disk, but may be a hexagonal disk, a member having a plurality of arms radially projecting from a center boss, or a member provided with rings at outer ends of arms. Moreover, there may be used a rotator in which a rotary shaft is provided at the center of a rectangular magnetic body, and permanent magnets are disposed symmetrically to each other relative to the rotary shaft.

According to the present invention, since a rotator made of a magnetic material is used and a plurality of permanent magnets are rigidly mounted on the rotator, the magnetic force from the plurality of permanent magnets can be reinforced by about 20% or more as compared with the case where permanent magnets are disposed on a rotary plate made of non-magnetic material, thus improving the finishing ability and finishing efficiency. Moreover, since the permanent magnets are irregularly disposed such that the magnetic forces are directed in the circumferential direction and in inwardly and outwardly radial directions, the contents of a container is allowed to flow irregularly and to move throughout the container by the rotating magnetic field. Accordingly, the abrasives function against the workpieces in all directions can be created. Thus even if the workpieces have complicated shapes, uniform surface finishing can still be conducted.

According to the present invention, a plurality of permanent magnets are regularly or irregularly disposed on a magnetic rotator. Consequently, by rotation of the rotator with a constant speed, abrasives and workpieces are made to flow irregularly in the circumferential direction and in the radial direction by alternating magnetic field caused by the rotation of the rotator. This is effective to easily and uniformly finish the surfaces of workpieces having complicated shapes, and more particularly, to finish the workpieces positioned at the center of the rotator.

In the arrangement of permanent magnets on the rotator according to the present invention, the permanent magnets are disposed a state that each of the permanent magnets is not divided into respective zones of poles partitioned on the rotator. That is to say, the plurality of permanent magnets are arranged randomly, so that the motion of the abrasives caused by the rotation of rotator are complicated, and the workpieces are irregularly moved, which is effective to uniformly finish the workpieces. In the case where the permanent magnets are disposed such that the poles N and S are arranged so as not to be distributed in respective zones, that is, arranged at random, it becomes possible to eliminate the dead point at the central portion of the rotator, and hence to improve the finishing efficiency.

In addition, since the permanent magnets are rigidly mounted on a magnetic rotator, it becomes possible to reinforce the magnetic force by about 20% or more as compared with the case where they are rigidly mounted on a non-magnetic rotator, and hence to significantly improve the finishing performance and finishing efficiency.

BRIEF DESCRIPTION OF THE DRAWINGS

The above and other objects, features, and advantages of the present invention become apparent from the following detailed description of several preferred embodiments that are shown in the accompanying drawings, in which.

DETAILED OF THE PREFERRED EMBODIMENTS

Embodiment 1

Figure 1:
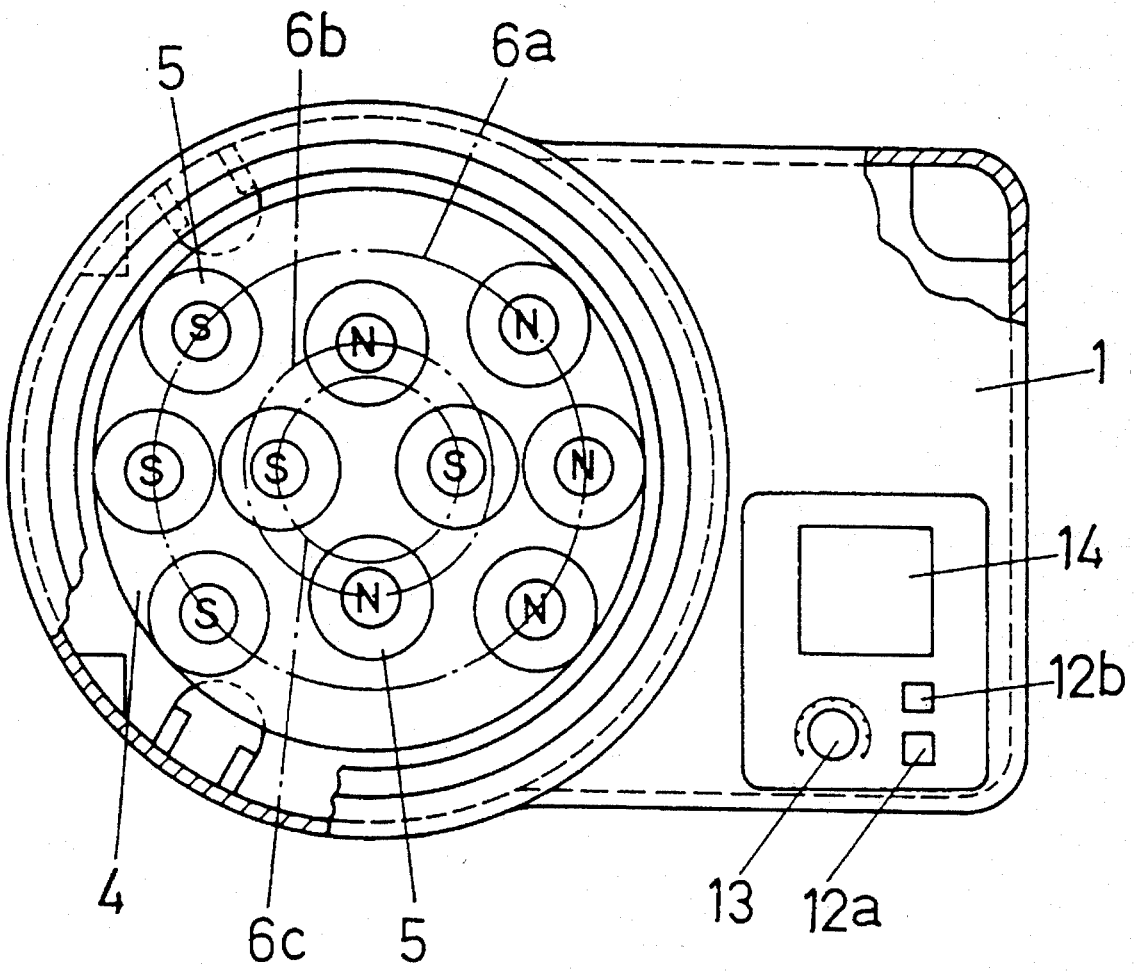
FIG. 1 is a plan view of a first embodiment of the present invention, with parts being partially cut-away.

A motor 2 is vertically fixed in a housing 1, and a rotary disk 4 (as a rotator) made of a magnetic material (for example, an iron plate) is fixed to a shaft 3 of the motor 2. Disk-like permanent magnets 5 are rigidly mounted on the rotary disk 4 such that the poles of each magnet 5 are directed vertically (see FIGS. 1 and 2). The permanent magnets 5, having the poles N and S in substantially the same number, are irregularly disposed such as to be slightly spaced from each other for preventing contact. The permanent magnets 5 must be disposed in a good balance for preventing vibration when the rotary disk 4 is rotated. For example, they are disposed symmetrically relative to the center of the rotary disk 4 as shown in FIG. 1.

The rotating magnetic field generated in the above-described construction must pass upwardly through a top plate 7. Accordingly, it is important to have the top plate 7 made of a perfectly non-magnetic material exerting no effect on the magnetic field. The top plate 7 is fitted to a stepped portion 8 of the housing 1.

Figure 4:
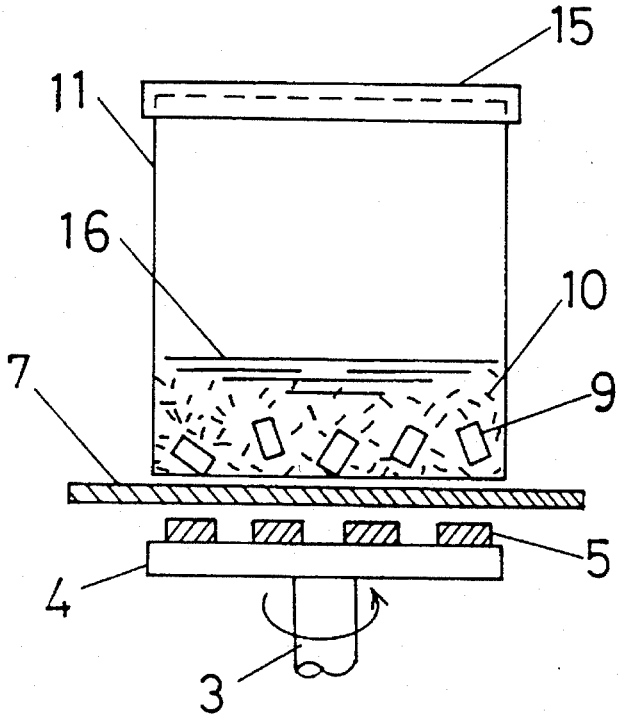
FIG. 4 is an enlarged view of the first embodiment, parts being partially cut-away, showing workpieces and the like in a container.

As shown in FIG. 4, a cylindrical container 11 (provided with a closing lid 15) made of synthetic resin, in which workpieces 9 (for example, small sized metal parts) and media 10 in a suitable amount are put, is placed on the top plate 7. In FIG. 4, reference numeral 16 indicates a finishing solution surface.

Figure 2:
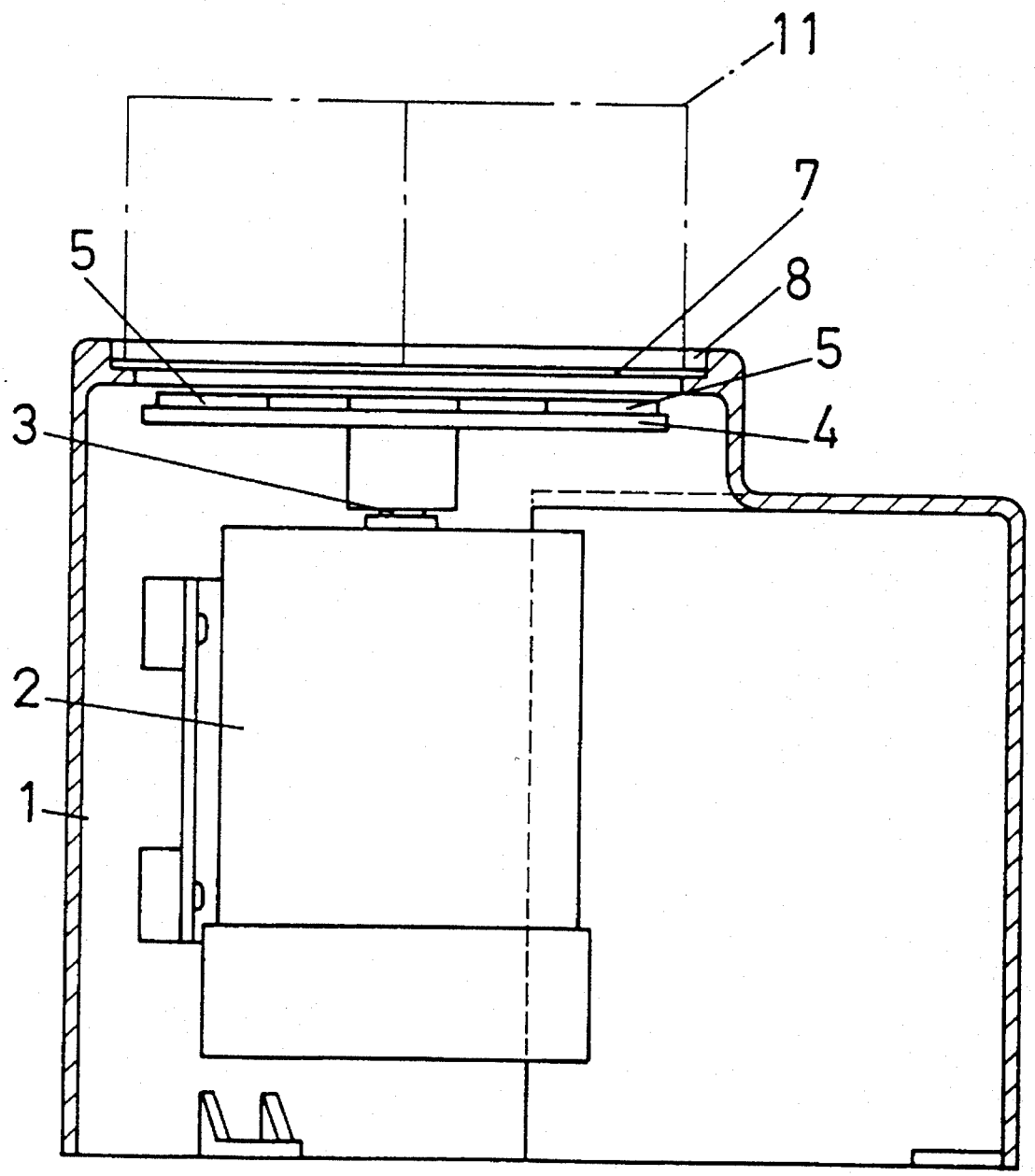
FIG. 2 is a front view of the first embodiment, with parts being partially cut-away.
Figure 3:
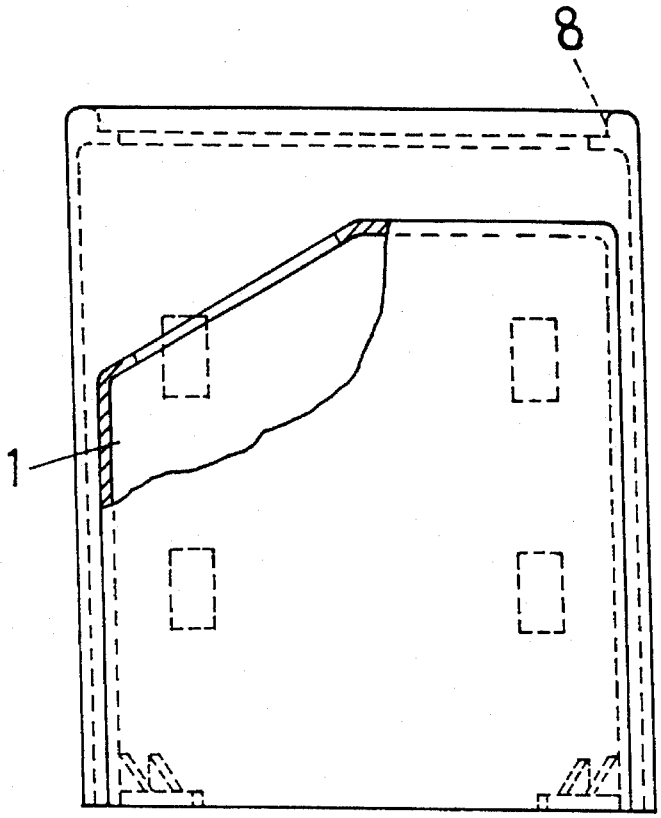
FIG. 3 is a side view of the first embodiment, with parts being partially cut-away.

In FIG. 1, reference numerals **12*a* indicates an ON switch: 12*b* is an OFF switch; 13 is a speed adjusting knob; and 14** is a timer.

In this embodiment, the media 10 (magnetic abrasives or a mixture of magnetic abrasives and non-magnetic abrasives) and the workpieces 9 are put in the cylindrical container 11 (see FIG. 4), and the cylindrical container 11 is placed on the top plate 7. The amount of the media 10 is preferably less than one quarter of the volume of the cylindrical container 11, and the amount of the workpieces 9 is preferably less than the amount of the media 10.

The rotary disk 4 is rotated at a rotational speed of 500–4000 rpm through rotation of the motor. At this time, irregular alternating magnetic fields are generated by the permanent magnets, and the media 10 flows irregularly. The workpieces thus move throughout the container, and as a consequence, even those workpieces having complicated shapes can be easily and uniformly finished.

Figure 5:
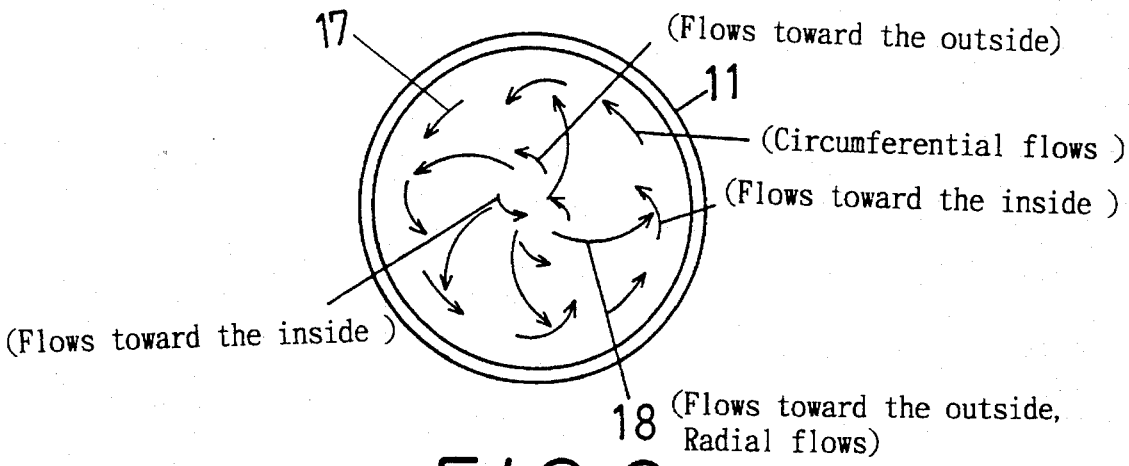
FIG. 5 is a plan view illustrating the motions of workpieces and media in a container.
Figure 6:
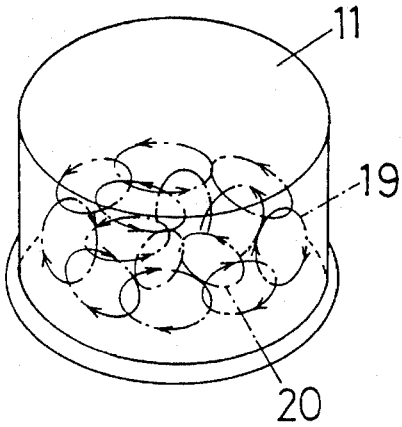
FIG. 6 is a perspective view illustrating the motions of workpieces and media in a container.
Figure 7:
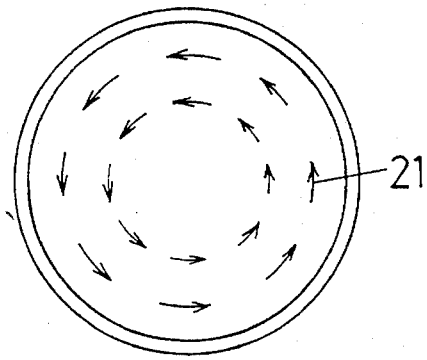
FIG. 7 (Prior Art)
FIG. 7 is a plan view illustrating the motions of workpieces and media in a container in prior art magnetic barrel finishing.
Figure 8:
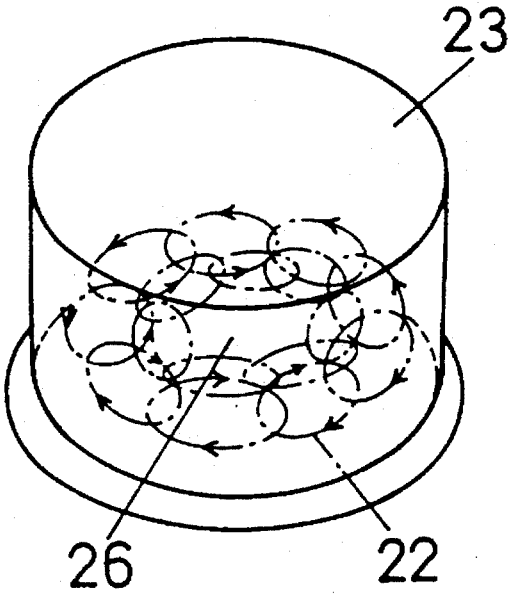
FIG. 8 (Prior Art)
FIG. 8 is a perspective view illustrating the motions of workpieces and media in a container in prior art magnetic barrel finishing.
Figure 9:
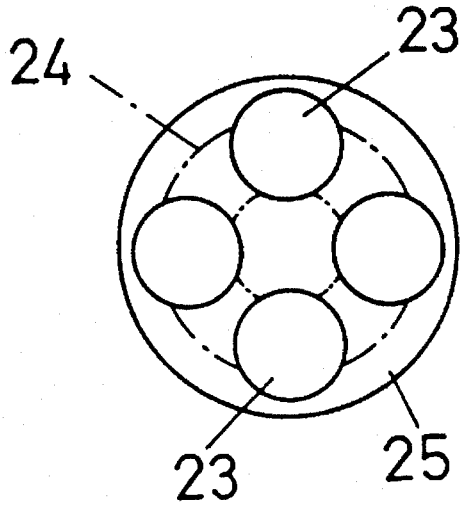
FIG. 9 (Prior Art)
FIG. 9 is a view illustrating a container placed in a finishing zone in prior art magnetic barrel finishing.

In this embodiment, as shown in FIG. 5, with respect to abrasives and workpieces, radial flows (arrow 18) thereof are generated, other than concentric flows (arrow 17) thereof. That is, as shown in FIG. 6, inward and outward flowing loops 20 are generated, other than circumferential flowing loops 19.

This eliminates the problem in which flows of abrasives and workpieces are not generated at the central portion of container 11, and accordingly, uniform finishing becomes possible even in the case where the cylindrical container 11 is placed at any position or in the case where a large volume cylindrical container having a diameter substantially equal to that of the top plate 7 is used.

In the prior art, the diameter of a container disposed on a rotary disk must be less than half that of the rotary disk. However, in the present invention, such a large volume container can be used, which makes it possible to finish large size workpieces which have conventionally been impossible to finish.

In the case of a container having a diameter the same as that of the container used in the prior art, the diameter of the rotary disk can be reduced, to thus make the whole size of the machine compact.

In the container, workpieces and media are suitably moved between the outer peripheral side and the center side of the container, so that the workpieces can be more uniformly finished.

Different complicated flows of workpieces and media can be generated by periodically changing the rotational direction of the motor at specified intervals of time. Namely, the flows are changed from the inside to the outside or from the outside to the inside, and thereby the portions of the workpieces contacting the media are changed. This is due to the random arrangement of the permanent magnets.

The workpieces are, therefore, fully finished in all directions.

In this embodiment, the same effect can be obtained even in the case where poles N and S of the permanent magnets 5 are replaced with each other.

According to this embodiment, the magnetic force can be reinforced by about 20% or more as compared with the prior art machine in which permanent magnets are rigidly mounted on a non-magnetic disk, and thereby the finishing ability can be significantly improved.

In this embodiment, water or other solutions may be added to the container 11 which contains media and workpieces 9. The water may contain an additive such as a surface active agent or rust preventive agent in a slight amount (for example, about 0.1%). In this case, the finishing ability can be further improved.

Alternatively, barrel finishing can be conducted without adding any water or other solution. That is to say, only the media 10 and workpieces 9 are contained in the container 11, and barrel finishing is conducted in a dry environment. In this case, a good finishing ability can be also obtained.

Embodiment 2

Figure 10:
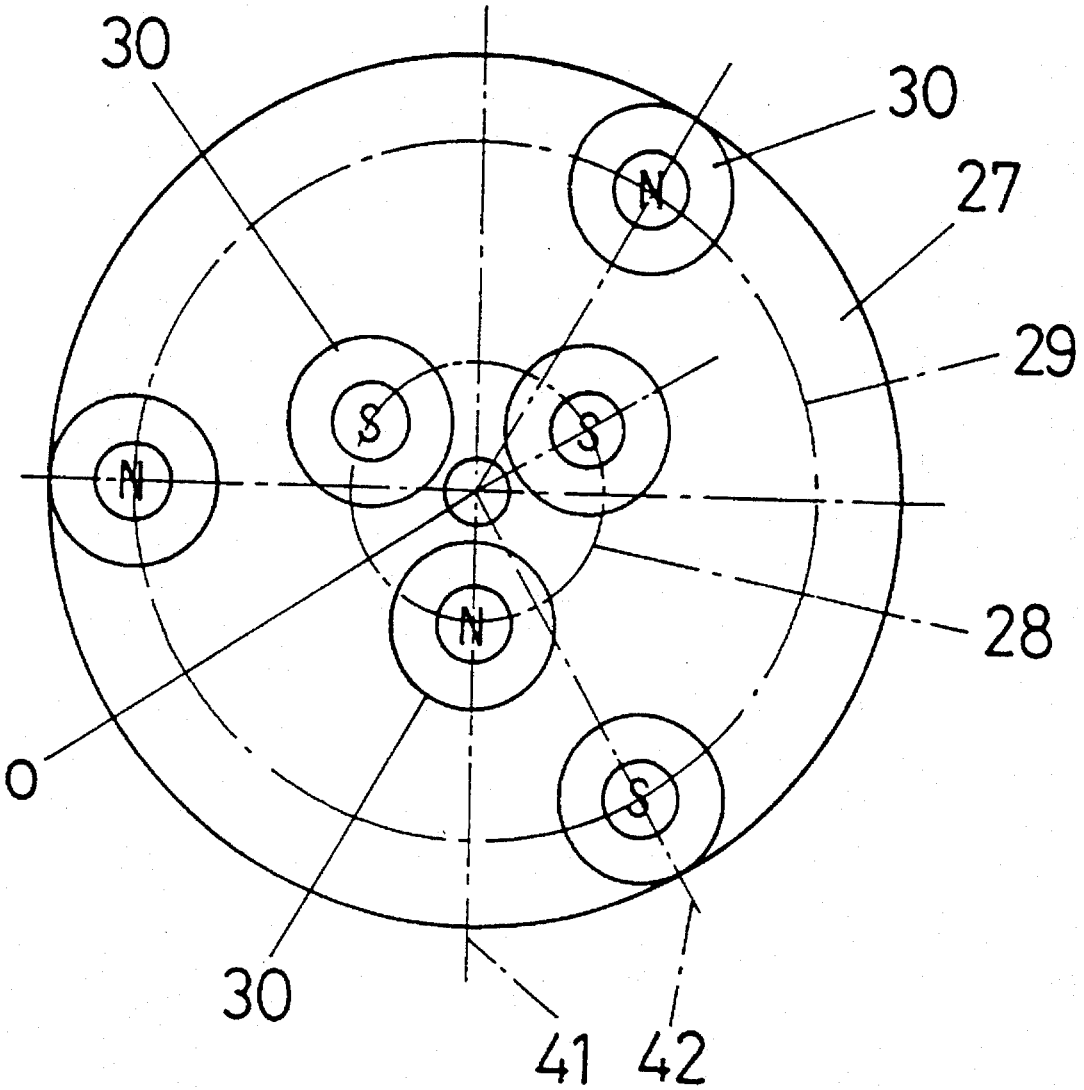
FIG. 10 is a plan view showing the arrangement of permanent magnets according to a second embodiment of the present invention.

The embodiment shown in FIG. 10 is used for a small size finishing machine (for example, a diameter of the rotary disk: 70–200 mm).

In the case where the rotary disk of magnetic material is rotated at a rotational speed of 1000–2400 rpm in the small size finishing machine, the following arrangement of permanent magnets is preferable for obtaining good finishing efficiency.

Three pieces of permanent magnets 30 are disposed at equal intervals along concentric circles 28, 29 around a center 0 of a magnetic rotary disk 27 in such a manner that two poles S and one pole N are disposed along the concentric circle 28, and two poles N and one pole S are disposed along the concentric circle 29. Moreover, the permanent magnets 30 on the concentric circles 28, 29 are disposed so as not to be positioned along the same radius line.

For example, the radius lines 41, 42 of the rotary disk passing through the centers of the permanent magnets disposed along the concentric circles 28, 29 are shifted from each other by an acute angle (for example 15° to 60°).

According to this embodiment, extremely large differences in the density of magnetic lines caused by the rotation of the magnetic rotary disk 27 can be eliminated, and thereby uniform finishing can be obtained. For example, an alternating change in poles (for example, N-S, S-N is not generated, and consequently the motions of abrasives become more random, to thus achieve improved finishing.

In this embodiment, the same effect can be obtained even by replacement of the poles N and S of the permanent magnets with each other.

Embodiment 3

Figure 11:
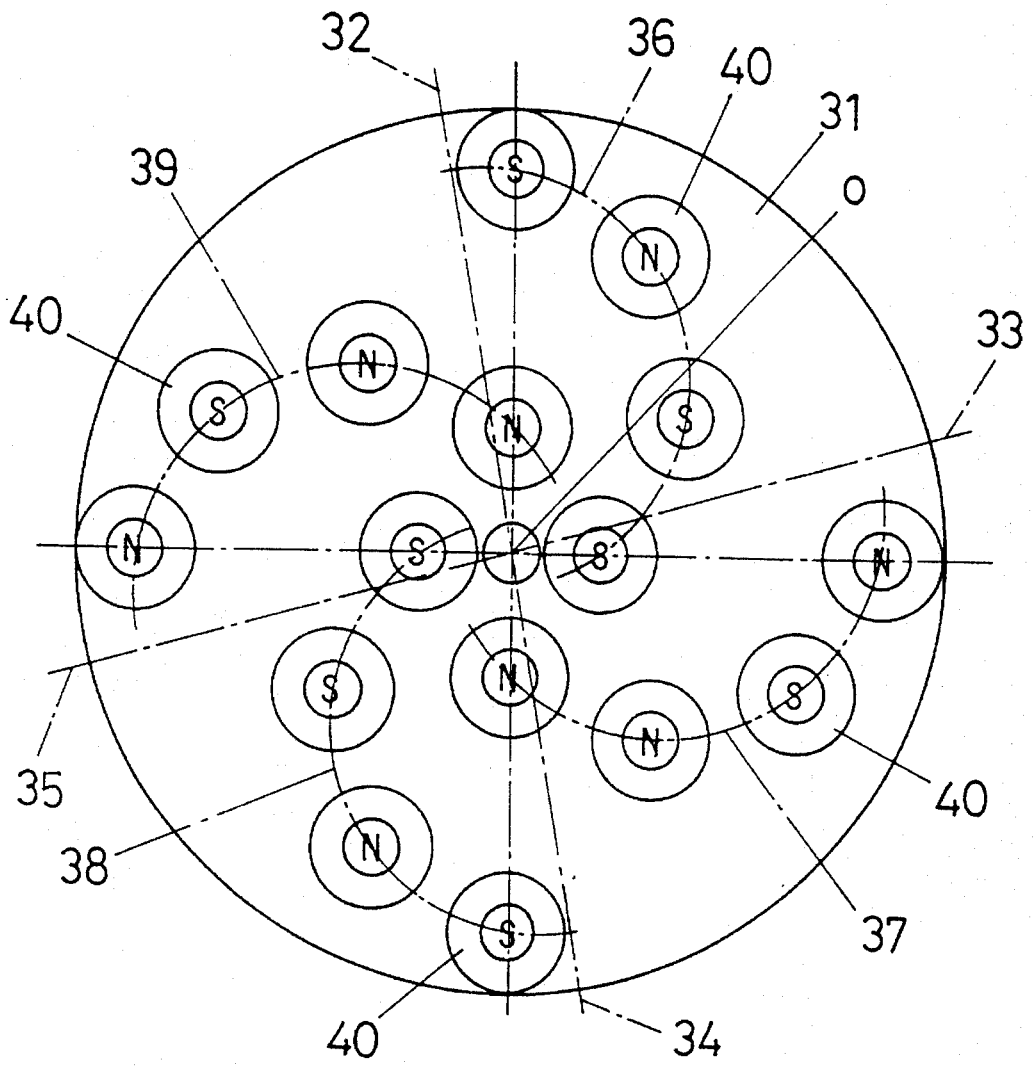
FIG. 11 is a plan view showing the arrangement of permanent magnets according to a third embodiment of the present invention.

The embodiment shown in FIG. 11 relates to the arrangement of permanent magnets which may be used for a large size finishing machine (for example, the diameter of the rotary disk: 200 mm or more).

Permanent magnets 40 on a rotary disk 31 made of a magnetic material are disposed such that the centers thereof are arranged along four curves 36, 37, 38 and 39 extending spirally at equal intervals in the outer peripheral direction from the center of the magnetic rotary disk 31. The permanent magnets disposed along the spiral curve 37 are symmetric, relative to the center of the rotary disk 31, to those disposed along the spiral curve 39, which is disposed symmetrically to the spiral curve 37 relative to the center of the rotary disk 31. Also, the permanent magnets disposed along the spiral curve 36 are symmetric, relative to the center of the rotary disk 31, to those disposed along the spiral curve 38, which is disposed symmetrically to the spiral curve 36 relative to the center of the rotary disk 31.

According to the arrangement of this embodiment, in the case where the area of the rotary disk 31 is partitioned into four zones by radius lines 32, 33, 34 and 35, each of the zones is not a zone of either poles N and S. That is to say, each of the zones contains both poles N and S as shown in FIG. 11.

Figure 12:
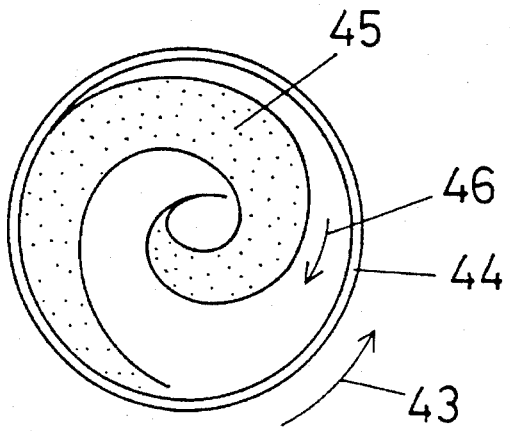
FIG. 12 is a plan view illustrating motion of abrasives in a container of the embodiment shown in FIG. 11.

When the magnetic rotary disk 31 on which the permanent magnets are arranged as shown in FIG. 11 is rotated in the direction shown by the arrow 43 in FIG. 12, media and abrasives 45 in a container 44 placed on the top plate of the rotary disk 31 rotates in the direction shown by the arrow 46 in FIG. 12, and thereby an excellent finishing effect can be obtained.

In the arrangement of permanent magnets according to the embodiment shown in FIG. 11, the finishing efficiency of the surface finishing machine is not essentially changed even in the case where the positions of the permanent magnets are slightly shifted from each other. However, in the case where they are shifted from each other to the extent that the magnetic lines of poles N and S are changed, the finishing effect is changed.

Figure 13:
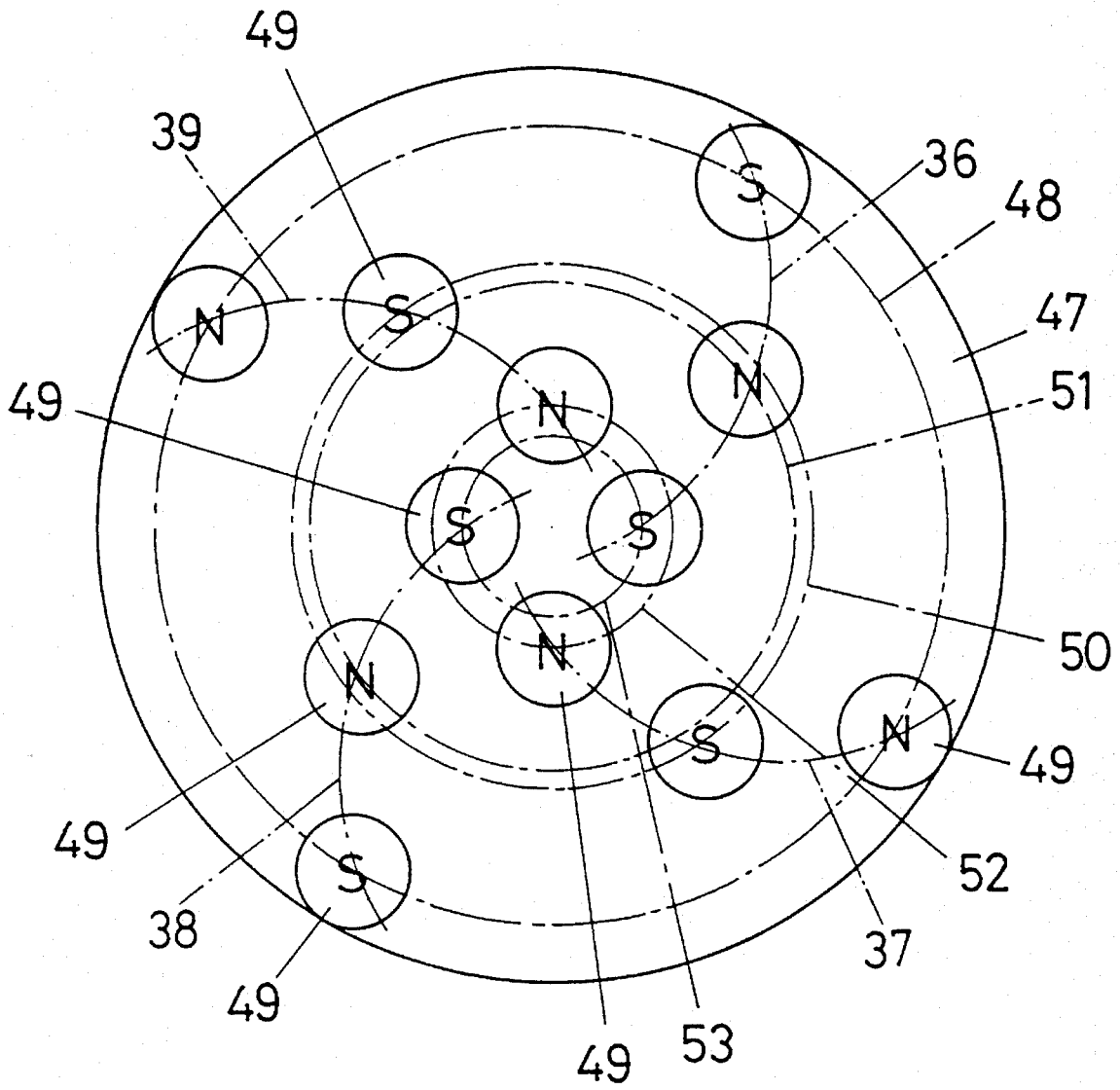
FIG. 13 is a plan view showing the arrangement of permanent magnets according to a fourth embodiment of the present invention.

In an arrangement of permanent magnets 69 according to an embodiment shown in FIG. 13, four pieces of the permanent magnets on the outermost side in the embodiment shown in FIG. 11 are omitted.

As is apparent from FIG. 13, the permanent magnets 49, disposed such that the centers thereof are arranged along the four spiral curves 36, 37, 38 and 39, are disposed along concentric circles 48, 50, 51, 52 and 53 around the center of the magnetic rotary disk 47.

Figure 14:
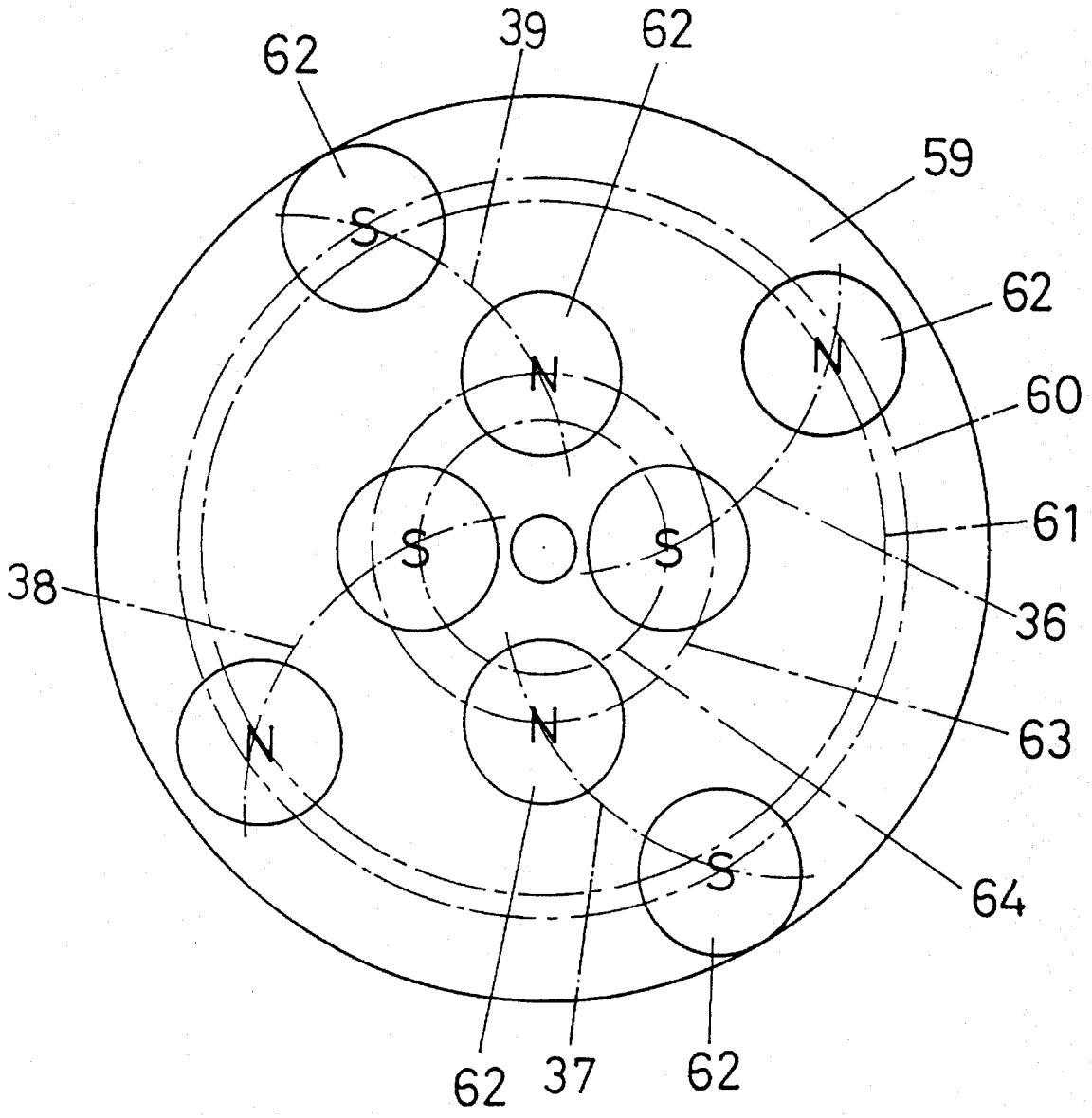
FIG. 14 is a plan view showing the arrangement of permanent magnets according to a fifth embodiment of the present invention.

In an arrangement of permanent magnets 62 of an embodiment shows in FIG. 14, four of the permanent magnets along the outermost side in the embodiment shown in FIG. 13 are omitted. Namely, eight of the permanent magnets (four pieces along the outermost side, and four pieces along the next inner side) are removed from those in the arrangement of the embodiment shown in FIG. 11. This is effective for a machine having a reduced size. Like the embodiment shown in FIG. 13, in this embodiment, the permanent magnets 62, having the centers disposed along four of the spiral curves 36, 37, 38 and 39, are disposed along concentric circles 60, 61, 63 and 64 around the center of the rotary disk 59.

Figure 15:
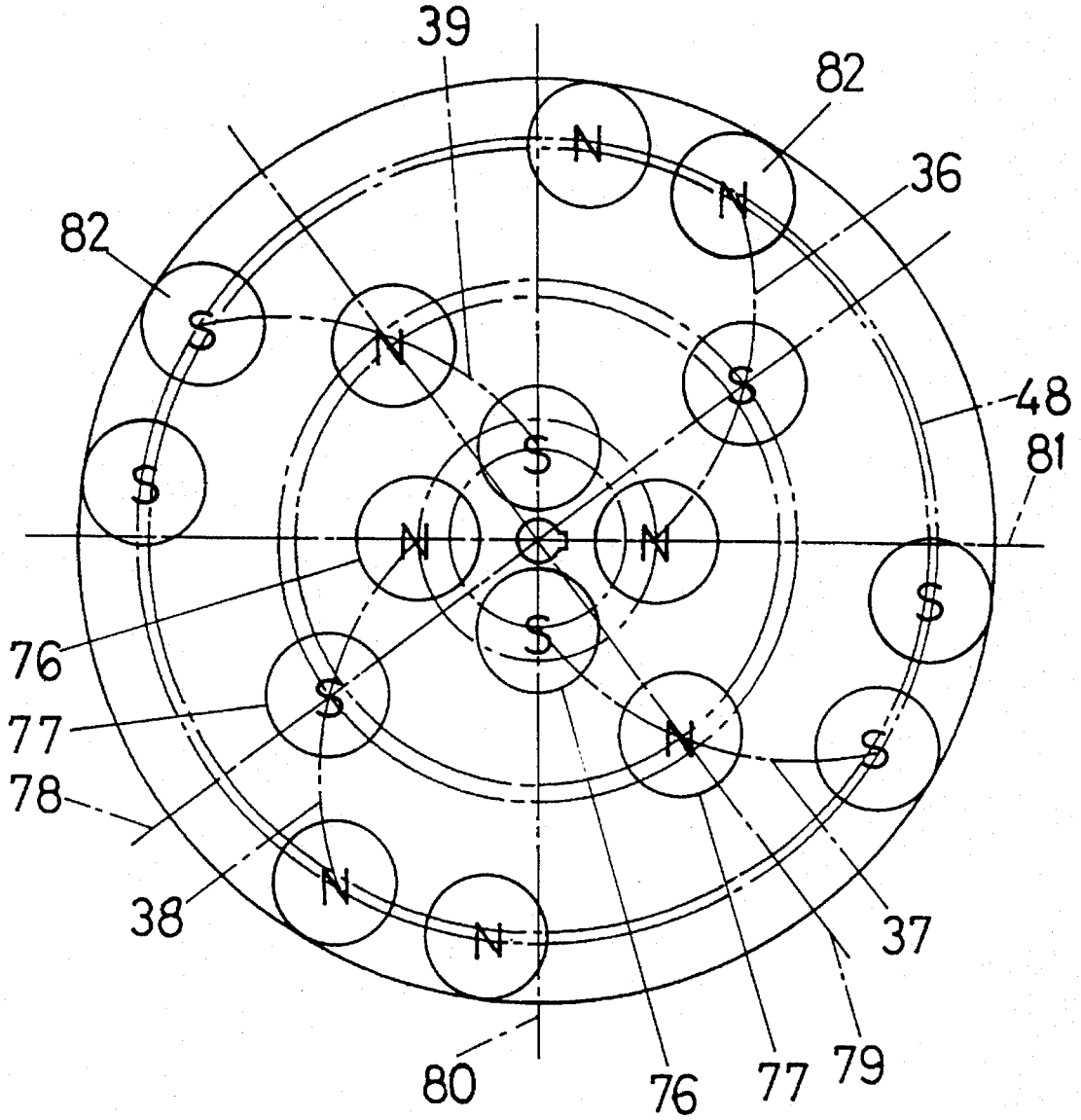
FIG. 15 is a plan view showing the arrangement of permanent magnets according to a sixth embodiment of the present invention.

An arrangement of permanent magnets 82 according to an embodiment shown in FIG. 15 is a modification of the arrangement of the permanent magnets according to the embodiment shown in FIG. 13. Namely, at portions adjacent to the outermost permanent magnets disposed on the outermost sides of four spiral curves 36, 37, 38 and 39, that is, along a concentric circle 48, permanent magnets having the same poles are disposed. With this arrangement of the permanent magnets, the outer side magnetic fields are reinforced more than in the arrangement shown in FIG. 13, thus obtaining increased magnetic fields. Accordingly, an excellent finishing efficiency can be obtained.

In this embodiment, the permanent magnets are disposed along the four spiral curves 36, 37, 38 and 39. However, the number of the spiral curves may be changed from 4 pieces to 3, 6 or 8 pieces.

Embodiment 4

Figure 16:
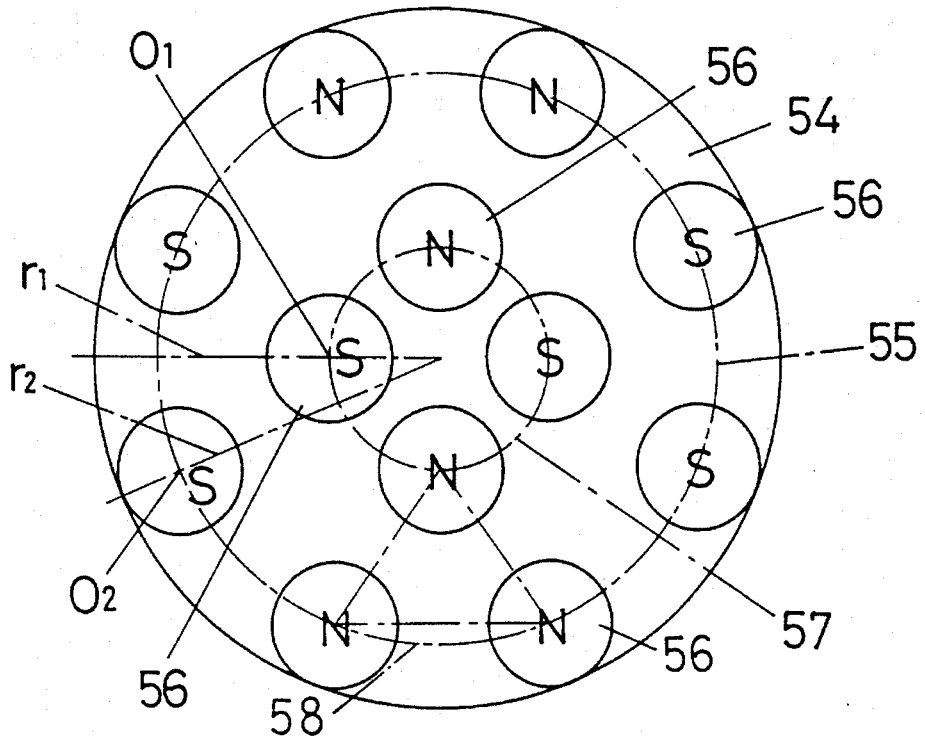
FIG. 16 is a plan view showing the arrangement of permanent magnets according to a seventh embodiment of the present invention.

In the embodiment shown in FIG. 16, along a concentric circle 55 on the outer peripheral side of a rotary disk 54 made of a magnetic material, eight pieces of permanent magnets 56 are disposed at equal intervals such that the poles thereof are arranged in the order of (N, N, S, S, N, N, S, S).

Moreover, along a concentric circle 57 on the inner side, four pieces of permanent magnets 56 disposed at equal intervals such that the poles thereof are arranged in the order of (N, S, N, S).

In this case, the centers (for example, 01, 02) of the permanent magnets along the inner and outer sides are preferably disposed along different radius lines (for example, lines r1, r2) of the magnetic rotary disk 54.

In the embodiment shown in FIG. 16, three pieces of the permanent magnets (one piece on the innerside, two pieces on the outer side) are substantially positioned at vertexes of a triangle 58.

Figure 17:
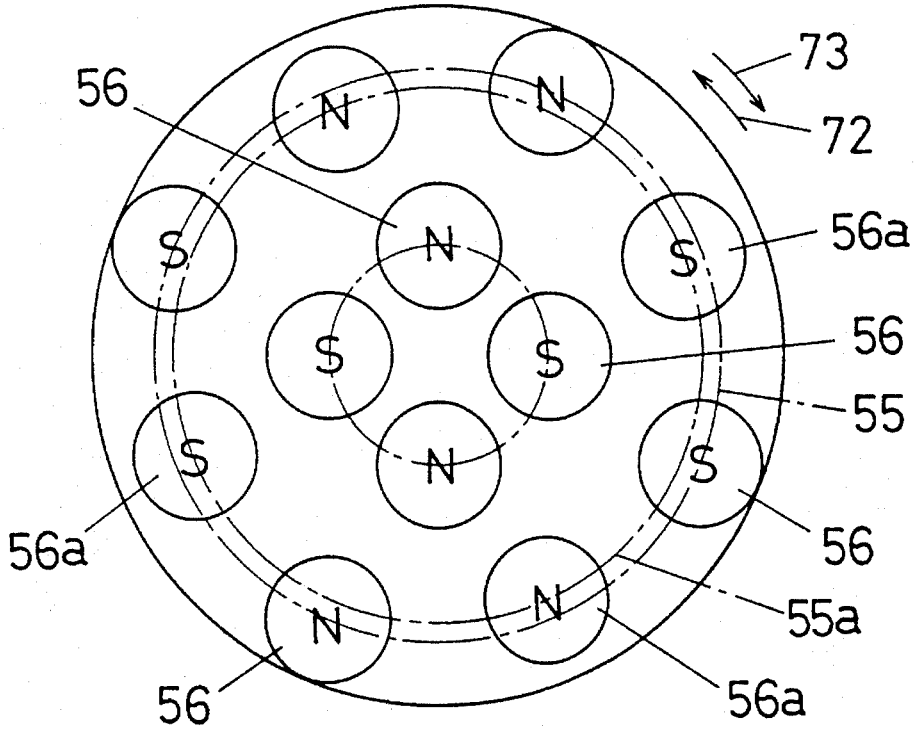
FIG. 17 is a plan view of an embodiment in which outer adjacent permanent magnets are disposed along different concentric circles from the embodiment shown in FIG. 16.

An arrangement of permanent magnets according to an embodiment shown in FIG. 17 is a modification of the arrangement of permanent magnets according to the embodiment shown in FIG. 16. Namely, the permanent magnets 56 on the outer side in the embodiment shown in FIG. 17 are divided into two groups, with one indicated by 56 and the other is indicated by 56*a*, and the adjacent permanent magnets 56, 56*a* are disposed such that the centers thereof are arranged along different concentric circles 55, 55*a*.

With this arrangement, the flows of media are changed between the case where the magnetic rotary disk 54 is rotated in the directions shown by the arrows 72 and 73 in FIG. 17. Accordingly, by rotation of the rotary disk 54, connected to a transmission capable of being reciprocally rotated, thus improving the finishing efficiency.

In this embodiment, the non-magnetic rotary disk of the known prior art barrel finishing machine on which permanent magnets are mounted, is replaced with the magnetic rotary disk. The present invention, therefore, is not limited to the number of the permanent magnets used, and is applicable for all of the known machines. Namely, as shown in FIG. 16, the area of the rotary disk 54 is partitioned into four zones and permanent magnets are regularly arranged in the zones. Each of the zones contains only pole N or pole S. Therefore, the motions of workpieces and media caused by the rotation of the magnetic rotary disk 54 becomes regular, like the known prior art finishing machine. However, since the machine of the present invention uses a magnetic rotary disk 54, replacing the non-magnetic rotary disk of the prior art finishing machine, a strong magnetic force can be obtained, so that relatively weak permanent magnets can be arranged and mounted on the magnetic rotary disk 54.

Also, in the barrel finishing machine of the present invention, the structure is simplified as compared with the prior art finishing machine.

Embodiment 5

Figure 18:
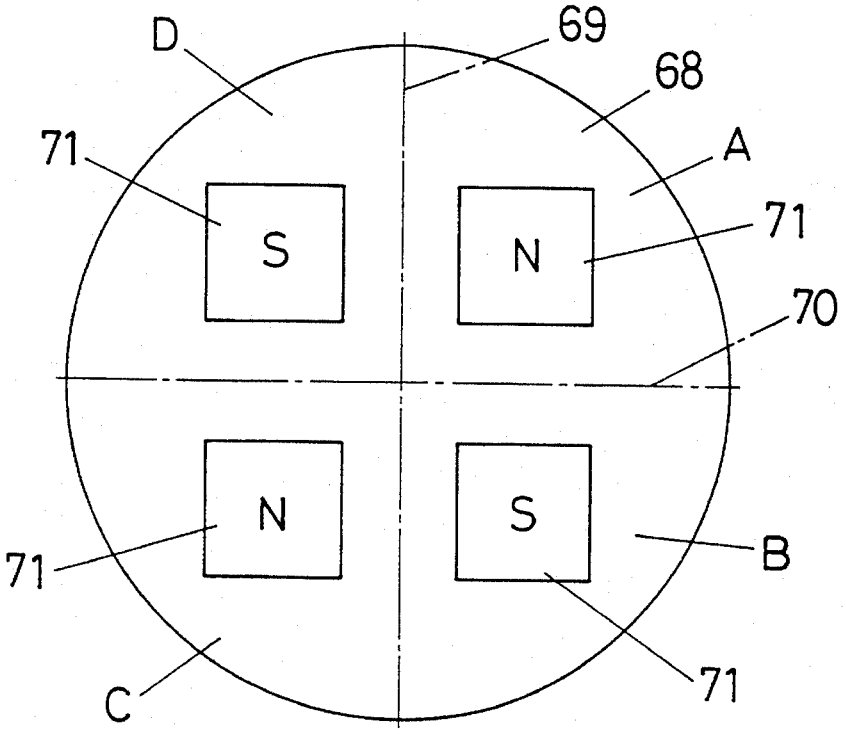
FIG. 18 is a plan view showing the arrangement of permanent magnets according to an eighth embodiment of the present invention.

In the embodiment shown in FIG. 18, the area of a magnetic rotary disk 68 is partitioned into zones A, B, C and D by partitioning lines 69, 70 passing through the center of the rotary disk 68 made of a magnetic material. Permanent magnets 71 are disposed in these zones such that the poles thereof are arranged in order of (N, S, N, S) and such that they are symmetric to each other relative to the center of the rotary disk 68.

Figure 19:
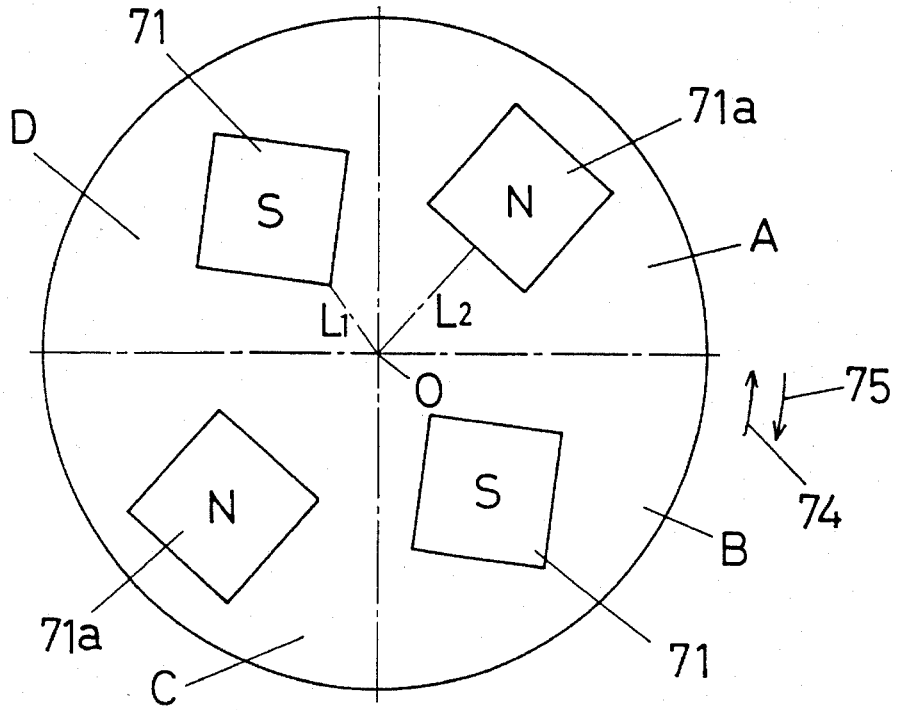
FIG. 19 is a plan view of an embodiment similar to that of FIG. 18 but in which poles N and S are disposed at portions different from each other in distance from the center of a rotary disk.

An arrangement of permanent magnets according to an embodiment shown in FIG. 19 is a modification of the arrangement of permanent magnets according to the embodiment shown in FIG. 18. In the embodiment shown in FIG. 19, the permanent magnets are disposed such that distances L1, L2 between the adjacent-permanent magnets 71, 71*a* and the center 0 of the rotary disk are different from each other. In this case, the permanent magnets must be arranged so as to be held in a preferable dynamic balance upon rotation.

With this arrangement, the flows of the media can be significantly changed depending on the rotational direction (such as arrows 74, 75 in FIG. 19) of the rotary disk 68. Consequently, by reciprocating rotation of the rotary disk 68, connected to a transmission capable of being reciprocally rotated, the finishing efficiency can be improved.

In this embodiment, the non-magnetic rotary disk of the known prior art barrel finishing machine on which permanent magnets are mounted is replaced with the magnetic rotary disk 68. The present invention, therefore, is not limited to the number of permanent magnets used, and is applicable for all of the known machines. Namely, as shown in FIG. 18, the area of the rotary disk 68 is partitioned into four zones, and permanent magnets are regularly arranged in the zones. Each of the zones contains only pole N or pole S. Therefore, the motions of the workpieces and media caused by the rotation of the magnetic rotary disk 68 become regular, like the known prior art finishing machine. However, since the machine of the present invention uses the magnetic rotary disk 68, replacing the non-magnetic rotary disk of the prior art finishing machine, a strong magnetic force can be obtained, so that relatively weak permanent magnets can be arranged and mounted on the magnetic rotary disk 68.

Also, in the barrel finishing machine of the present invention, the structure is simplified comparing with the prior art finishing machine.

Embodiment 6

Figure 20:
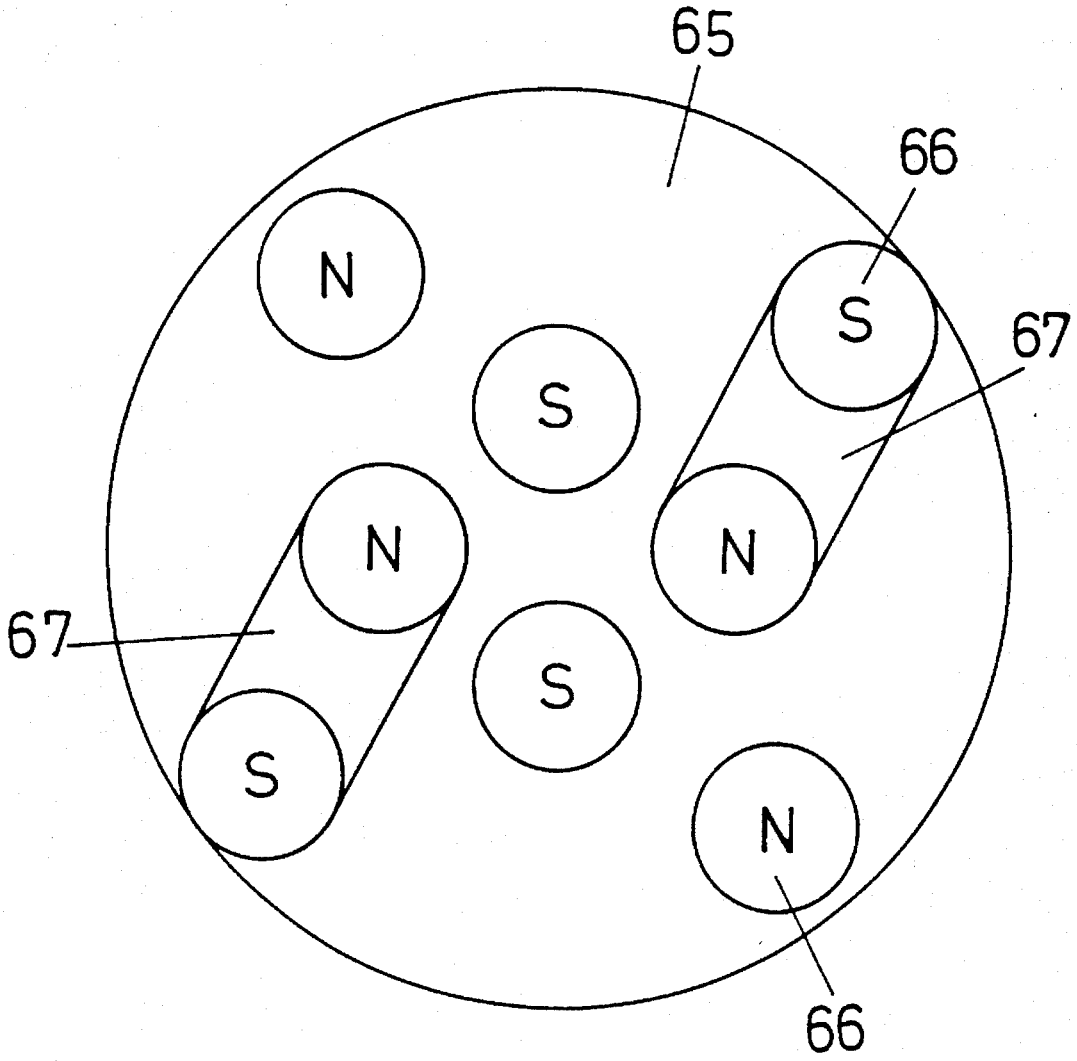
FIG. 20 is a plan view showing an arrangement of permanent magnets according to a ninth embodiment of the present invention.

In the embodiment shown in FIG. 20, magnet connecting plates 67, 67 for fixing different poles of permanent magnets 66, 66 disposed on the inner and outer sides are buried in a non-magnetic rotary disk 65 in such a manner as to maintain the rotational balance.

Each of the magnetic connecting plates 67 is partially or wholly buried in the non-magnetic rotary disk 65 or fixed on the non-magnetic rotary disk 65.

Figure 21:
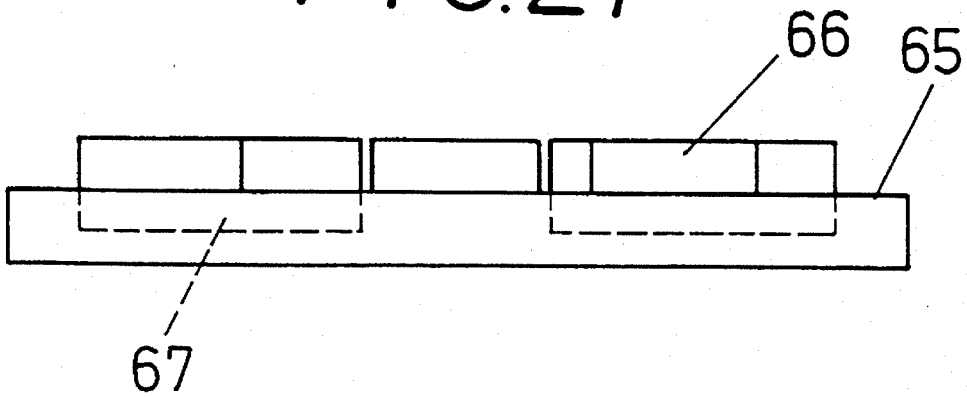
FIG. 21 is a front view of the embodiment shown in FIG. 20.
Figure 22:
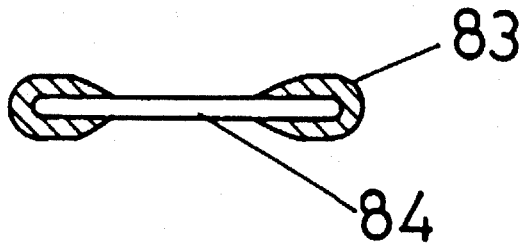
FIG. 22 is an enlarged side view of an abrasive medium used in the present invention, with parts being partially cut-away.
Figure 23:
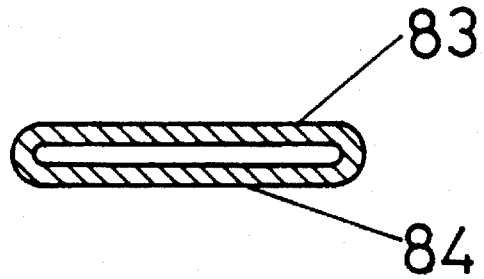
FIG. 23 is an enlarged cut-away side view of another abrasive medium used in the present invention.
Figure 24:
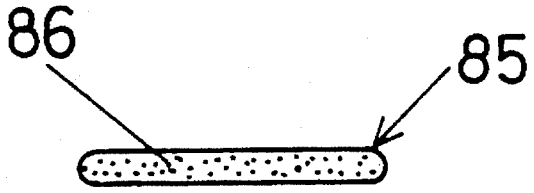
FIG. 24 is an enlarged cut-away side view of other abrasive medium used in the present invention.

The other permanent magnets 66, 66 are rigidly mounted on the non-magnetic rotary disk 65 without magnetic connecting plates 67 as shown in FIG. 20 and FIG. 21.

In each case, the upper surfaces of all of the permanent magnets are preferably adjusted to be at the same level.

An iron plate or other ferromagnetic plates may be used as the magnetic connecting plate 67.

The presence or absence of the magnetic connecting plates causes about a 20% difference in the strength of the magnetic force produced by the permanent magnets. That is to say, the magnetic force which is produced by the permanent magnets fixed on the magnetic connecting plates 67 is reinforced by about 20% or more as compared with the magnetic force produced by the other permanent magnets which are rigidly mounted on the non-magnetic rotary disk 65 without magnetic connecting plates 67. The different in the strength of the magnetic force is effective to form irregular magnetic fields during the rotation of the non-magnetic disk 65 and hence to impart complicated motions to the magnetic abrasives. This makes it possible to easily and uniformly finish workpieces having relatively complicated shapes.

Although the present invention has fully been described by referring to the particular preferred embodiments of the present invention, it should be understood that various changes and modifications may be made without departing from the spirit and scope of the invention as defined in the appended claims.

What is claimed is:

1. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets are disposed along three concentric circles around the center of said rotator, including an outermost concentric circle, an intermediate concentric circle and an innermost concentric circle, such that three N poles and three S poles are directed in the same direction and disposed at substantially equal intervals along said outermost concentric circle so as to be substantially symmetrical relative to the center of said rotator, two N poles are directed in the same direction and disposed along said intermediate concentric circle so as to be substantially symmetrical relative to the center of said rotator, and two S poles are directed in the same direction and disposed along said innermost concentric circle so as to be substantially symmetrical relative to the center of said rotator.

2. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets are disposed along three concentric circles around the center of said rotator, including an outermost concentric circle, an intermediate concentric circle and an innermost concentric circle, such that three N poles and three S poles are directed toward said container and disposed at substantially equal intervals along said outermost concentric circle so as to be substantially symmetrical relative to the center of said rotator, two S poles are directed toward said container and disposed along said intermediate concentric circle so as to be substantially symmetrical relative to the center of said rotator, and two N poles are directed toward said container and are disposed along said innermost concentric circle so as to be substantially symmetrical relative to the center of said rotator.

3. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets are disposed along a plurality of concentric circles around the center of said rotator; and wherein said plurality of permanent magnets have centers that are arranged, at least along adjacent ones of said plurality of concentric circles, along different radius lines of said rotator.

4. The arrangement in a magnetic barrel finishing machine as set forth in claim 3, wherein said plurality of permanent magnets are disposed such that one N pole and two S poles are directed toward said container and arranged at substantially equal intervals along an inner one of said plurality of concentric circles around the center of said rotator, and two N poles and one S pole are directed toward said container and arranged at substantially equal intervals along an outer one of said plurality of concentric circles.

5. The arrangement in a magnetic barrel finishing machine as set forth in claim 3, wherein said plurality of permanent magnets are disposed such that one S pole and two N poles are directed toward said container and arranged at substantially equal intervals along an inner one of said plurality of concentric circles around the center of said rotator, and two S poles and one N pole are directed toward said container and arranged at substantially equal intervals along an outer one of said plurality of concentric circles.

6. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets have centers disposed along a plurality of spiral curves that extend at substantially equal intervals in an outward direction from a central portion of said rotator; and wherein said permanent magnets disposed along one of said spiral curves are substantially symmetric, relative to the center of said rotator, to said permanent magnets disposed along another one of said spiral curves, said another one of said spiral curves being substantially symmetric, relative to the center of said rotator, to said one of said spiral curves.

7. The arrangement in a magnetic barrel finishing machine of claim 6, wherein four of said spiral curves extend spirally outward at substantially equal intervals from the central portion of said rotator and said permanent magnets are arranged such that sets of permanent magnets having poles thereof in an order of N-N-S-N outwardly from the central portion are alternated with sets of permanent magnets having poles in an order of S-S-N-S outwardly from the central portion on said four spiral curves.

8. The arrangement in a magnetic barrel finishing machine of claim 6, wherein four of said spiral curves extend spirally outward at substantially equal intervals from the central portion of said rotator and said permanent magnets are arranged such that sets of said permanent magnets having poles thereof in an order of N-S-N outwardly from the central portion are alternated with sets of said permanent magnets having poles in an order of S-N-S outwardly from the central portion on said four spiral curves.

9. The arrangement in a magnetic barrel finishing machine of claim 6, wherein four of said spiral curves extend spirally outward at substantially equal intervals from the central portion of said rotator, and said permanent magnets are arranged such that sets of said permanent magnets having poles thereof in an order of N-S outwardly from the central portion are alternated with sets of permanent magnets having poles in an order of S-N outwardly from the central portion for each of said spiral curves.

10. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets have centers disposed along a plurality of spiral curves that extend at substantially equal intervals in an outward direction from a central portion of said rotator;

wherein said permanent magnets disposed along one of said spiral curves are substantially symmetric, relative to the center of said rotator, to said permanent magnets disposed along another one of said spiral curves, said another one of said spiral curves being substantially symmetric, relative to the center of said rotator, to said one of said spiral curves; and wherein each of said permanent magnets that are outermost along said spiral curves has an additional permanent magnet having the same pole orientation disposed adjacent thereto.

11. The arrangement in a magnetic barrel finishing machine of claim 10, wherein four of said spiral curves extend spirally outward at substantially equal intervals from the central portion of said rotator, and said permanent magnets disposed along said spiral curves are arranged such that sets of said permanent magnets having poles thereof in an order of N-S-N outwardly from the central portion are alternated with sets of said permanent magnets having poles in an order of S-N-S outwardly from the central portion for each of said spiral curves.

12. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said plurality of permanent magnets are disposed along inner and outer concentric circles around the center of said rotator such that two of said permanent magnets having N poles and two of said permanent magnets having S poles alternate at substantially equal intervals along said inner concentric circle and four of said permanent magnets having N poles and four of said permanent magnets having S poles alternate at substantially equal intervals along said outer concentric circle;

wherein said permanent magnets have centers that are positioned along said inner and outer concentric circles such that said centers are not positioned along the same radius lines of said rotator; and wherein said rotator comprises four zones defined by partitioning lines that pass through the center of said rotator, each zone having only ones of said permanent magnets therein that have the same pole directed toward said container.

13. The arrangement in magnetic barrel finishing machine of claim 12, wherein said outer concentric circle has said permanent magnets disposed there along such that said centers of adjacent ones of said permanent magnets along said outer concentric circle have different length radii from the center of said rotator.

14. An arrangement in a magnetic barrel finishing machine, comprising:

a rotator made of a magnetic material;

a plurality of permanent magnets rigidly mounted on said rotator; and a container for containing workpieces to be finished and an abrasive medium comprising a magnetic material;

wherein said container is located above said rotator such that a gap is between said container and said rotator;

wherein said rotator comprises four zones defined by partitioning lines that pass through the center of said rotator;

wherein said plurality of permanent magnets are arranged in said four zones of said rotator so as to be disposed substantially symmetrical with respect to the center of said rotator and so that poles of said permanent magnets that are directed toward said container are arranged in N-S order;

wherein said plurality of permanent magnets in said four zones comprises a first set of permanent magnets that are disposed substantially symmetrical with respect to the center of said rotator and a second set of permanent magnets that are disposed substantially symmetrical with respect to the center of said rotator, said first set of permanent magnets being spaced a distance from the center of said rotator that is different from the distance said second set of permanent magnets are spaced from the center of said rotator.

15. An arrangement in a magnetic barrel finishing machine, comprising:

a rotator made of a non-magnetic material;

a plurality of connecting plates made of a magnetic material fixed in said rotator;

a first plurality of permanent magnets fixed on said connecting plates such that each of said connecting plates has two of said first plurality of permanent magnets thereon with different poles directed away from said connecting plates;

a second plurality of permanent magnets fixed on said rotator; and a container for containing workpieces to be finished and an abrasive medium that comprises a magnetic material, wherein said container is located above said rotator such that a gap is between said container and said rotator.

* * * * *